US005518243A

United States Patent [19]

Redman

[11] Patent Number: 5,518,243

[45] Date of Patent: May 21, 1996

[54] WOOD-TYPE GOLF CLUB HEAD WITH IMPROVED ADJUSTABLE WEIGHT CONFIGURATION

[75] Inventor: John T. Redman, Port St. Lucie, Fla.

[73] Assignee: Zubi Golf Company, Port St. Lucie, Fla.

[21] Appl. No.: 523,498

[22] Filed: Sep. 1, 1995

Related U.S. Application Data

[63] Continuation-in-part of Ser. No. 377,691, Jan. 25, 1995.

[51] Int. Cl.[6] ..... A63B 53/04

[52] U.S. Cl. ..... 473/334; 473/350

[58] Field of Search ..... 273/167 R, 167 A, 273/167 F, 169, 170, 171, 172, 173, 174, 193 R, 193 A, 194 R, 186.2, 79, 167 H, 77 R

[56] References Cited

U.S. PATENT DOCUMENTS

| | | | |
|---|---|---|---|
| 1,213,382 | 1/1917 | Kent . | |
| 1,306,029 | 6/1919 | Robertson | 273/171 |
| 1,446,577 | 2/1923 | Nix . | |
| 1,534,600 | 4/1925 | Mattern | 273/169 |
| 1,538,312 | 2/1925 | Beat . | |
| 1,575,364 | 3/1926 | Hodgkins | 273/171 |
| 2,332,342 | 10/1943 | Reach . | |
| 2,517,245 | 8/1950 | Scott . | |
| 2,750,194 | 6/1956 | Clark | 273/171 |
| 3,084,940 | 4/1963 | Cissel . | |
| 3,610,630 | 10/1971 | Glover . | |
| 3,695,618 | 10/1972 | Woolley et al. . | |
| 3,975,023 | 8/1976 | Inamori . | |
| 4,008,896 | 2/1977 | Gordos . | |
| 4,085,934 | 4/1978 | Churchward . | |
| 4,432,549 | 2/1984 | Zebelean . | |
| 4,730,830 | 3/1988 | Tilley . | |
| 4,811,949 | 3/1989 | Kobayashi . | |
| 5,076,585 | 12/1991 | Bouquet . | |
| 5,197,737 | 3/1993 | Desbiolles et al. . | |

*Primary Examiner*—Sebastiano Passaniti
*Attorney, Agent, or Firm*—Quarles & Brady

[57] ABSTRACT

A wood type golf club having a weight system on the club head including a cavity, weights and a weight distributor therein. The weight distributor includes an array of apertures designed to receive spherical weights positioned in apertures to adjust the center of the mass of the club head in accordance with particular swing characteristics of a golfer using the golf club. The cavity and the weight distributor are located at the lower back of the club head and substantially behind the ball striking face and when attached are oriented in a manner as to give the appearance of a one piece club head and maximize the weight distribution affect relative for the ball striking face. The weight distributor is a one piece unit which provides easy mounting and dismounting of the weight system.

8 Claims, 2 Drawing Sheets

WOOD-TYPE GOLF CLUB HEAD WITH IMPROVED ADJUSTABLE WEIGHT CONFIGURATION

CROSS-REFERENCES TO RELATED APPLICATIONS

This application is a continuation-in-part of application Ser. No. 08/377,691, filed on Jan. 25, 1995, now pending.

FIELD OF THE INVENTION

The present invention relates to golf clubs and, in particular, to wood-type golf clubs having an improved weight distribution system. The wood-type golf club can be a driver or numbered wood. The wood-type golf club can be made of an aluminum, steel, titanium, graphite, or any other material or combination of materials presently available or developed in the future.

BACKGROUND OF THE INVENTION

It is well known to individually weight a golf club head in accordance with the specific characteristics of the golfer using the club. Customizing a golf club head by weight is particularly useful due to the wide variety of different shaft materials and flexes available to the golfer. Golf equipment manufacturers have always been extremely limited in custom fitting a golfer with a club or clubs to fit the particular individual. To custom fit a club, manufacturers have few options, including adjusting the length of the club, the size of the grip, the flex of the shaft, the loft angle and the lie angle.

The most efficient way to fit a club to an individual is to have the proper head weight for that particular individual and for the other club characteristics. Some players may require more weight toward the toe of the club head while other players may require more weight toward the heel of the club head depending on the particular swing characteristics of the individual. Since club heads are mass produced by manufacturers, the weighing of the club heads is always very similar and usually can only be easily adjusted by adding lead tape to the outside of the finished product or by adding lead powder to an internal cavity of the club head. In the case of the lead tape, a golfer is able to add weight to any part of the outside of the club head and in the case of adding lead powder the golfer usually has only one option of where to add the powder. However, in both cases the addition of the extra weight adds weight to the club head which changes the flex of the shaft, the kick point, and the swingweight of the club. With these changes in the overall playability of the club, it is extremely difficult, if not impossible, to custom fit a golf club to an individual.

There have been many attempts to weight a golf club head in the prior patent art. For example, the Bassin U.S. Pat. No. 3,096,982, shows a golf club which may be adjustably weighted using a plurality of weights which are dispersed in a plurality of pockets to vary the weight of the head. The Beat U.S. Pat. No. 1,543,691, shows a golf club head which uses cylindrical aluminum carriers to hold and position weights within the club head. The Churchwood U.S. Pat. No. 4,085,934, shows a golf club having an impact block located in the club head having a plurality of openings into which rod-shaped weights are slidably inserted in specific positions to adjust the weight of the club head. The Gordas U.S. Pat. No. 4,008,896, shows a weight adjustor assembly that includes an elongated tube disposed in an elongated cavity in the club head that is substantially parallel to the ball striking surface of the head. The Kobayashi U.S. Pat. No. 4,811,949, shows a hollow space for receiving a weight adjusting member at the outer surface of the sole. The Legh U.S. Pat. No. 863,728, shows a golf club head with a lead weight placed directly behind the ball striking face. The Reach U.S. Pat. No. 2,332,342, shows an adjustable weight distribution system for irons with weights directly behind and as part of the striking face of the irons.

The prior art demonstrates a collective approach to adjustable weight distribution in wood-type club heads in which the weights are arranged near the striking face of the club and oriented horizontally or otherwise secured in an awkward, multi-part construction with cover plates or other securing members.

These designs not only make adjustments difficult and less effective, but also interfere with the ability to retain a hollow area behind the striking face for feel and forgiveness considerations, particularly of importance in wood-type clubs.

SUMMARY OF THE INVENTION

The present invention relates to a golf club head which may be finely tuned to the shaft to individually fit a golfer whereby the center of gravity and/or sweet spot of the club head may be adjusted to match the golfer's particular swing characteristics, resulting in longer, more accurate golf shots. The present invention contemplates using a weight distributor having a plurality of apertures structured to receive individual weights. The weight distributor of the present invention is located at the back end of the club head, and thereby gains advantage and effect in the distance of the adjustable weights from the striking face of the club and rests in a pre-formed cavity that extends from the sole of the club and forms part of the sole of the club. The weight distributor itself is preferably in the shape of a D and may be removably secured to the club by screws or other fasteners that permit convenient mounting and dismounting. Alternatively, the weight distributor can be in the shape of a horseshoe or any other similar type design.

The weight distributor is constructed to form a cup-like structure that hold weights in their position when held upright. The weight distributor is preferably constructed to have a bottom surface that acts as a sole to provide a stop point for the weights when they are inserted into the apertures of the weight distributor. The apertures may include rubber or other elastic inserts to securely hold the weights against an elastic cushion lining the cavity that the weight distribution engages.

Once removed, the existing weight distribution may be altered to move the bulk of the weight more toward the toe or towards the heel or anywhere in between as well as toward and away from the striking face. This allows the golfer to correctly fit the club head to his swing characteristics without altering the playability of the shaft, or changing the swingweight or overall weight of the club.

Among the objectives of the present invention is the provision of a golf club which may be customized to the swing characteristics of an individual golfer. Another object is the provision of a golf club head in which the club head may be adjustably weighted in a simple and efficient manner. Another object is the provision of a weighted golf club head in which the center of gravity and center of percussion may be adjusted relative to the center of the ball striking face to accommodate swing characteristics of a particular golfer. Another advantage is to maximize the weight distribution effect of the system without increasing the weights needed for the effect. Another advantage is to provide an array of weight locations to adjust for swing errors not only in a heel and toe direction but also fore and aft in the striking direction. Another object is the provision of a one piece weight distributor having apertures that do not extend all the way through the weight distributor for easy mounting and dismounting of the weight distributor and the weights.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the enclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
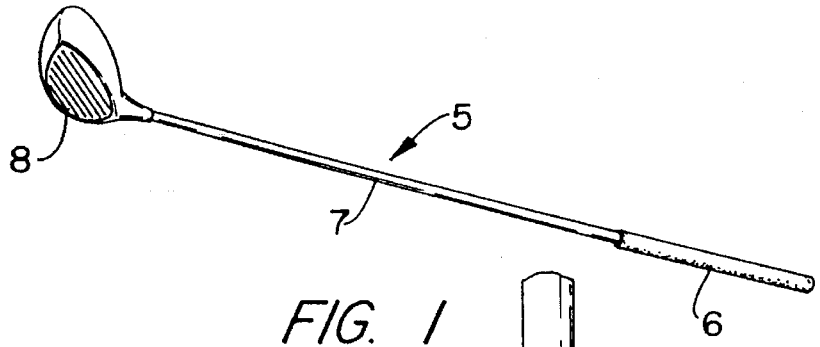
FIG. 1 illustrates a golf club in accordance with the present invention.

Referring to FIG. 1, a golf club 5 is made up of a grip 6, a shaft 7, and a club head 8. The grip 6 is conventional and made of rubber or leather to provide a comfortable, non-slipping handle for the golfer to hold during the execution of a golf shot. The shaft 7 may be made of aluminum, steel, graphite, glass or any of the currently available modern materials on the market or developed in the future. The club head 8 of the present invention may be made of a lightweight metal, such as titanium, aluminum, graphite, porcelain, or any other lightweight extremely durable material.

Figure 2:
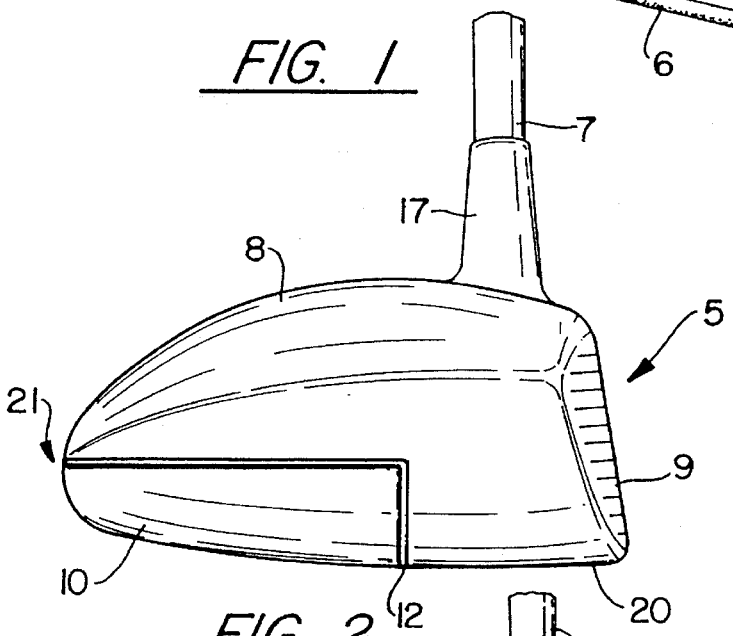
FIG. 2 illustrates a side elevational view of a golf club head used with the present invention.
Figure 4:
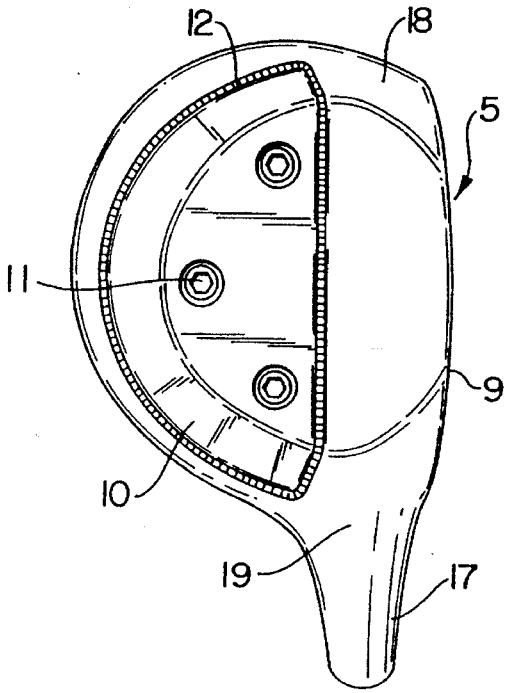
FIG. 4 illustrates a bottom plan view of a golf club head embodiment used with the present invention.
Figure 5:
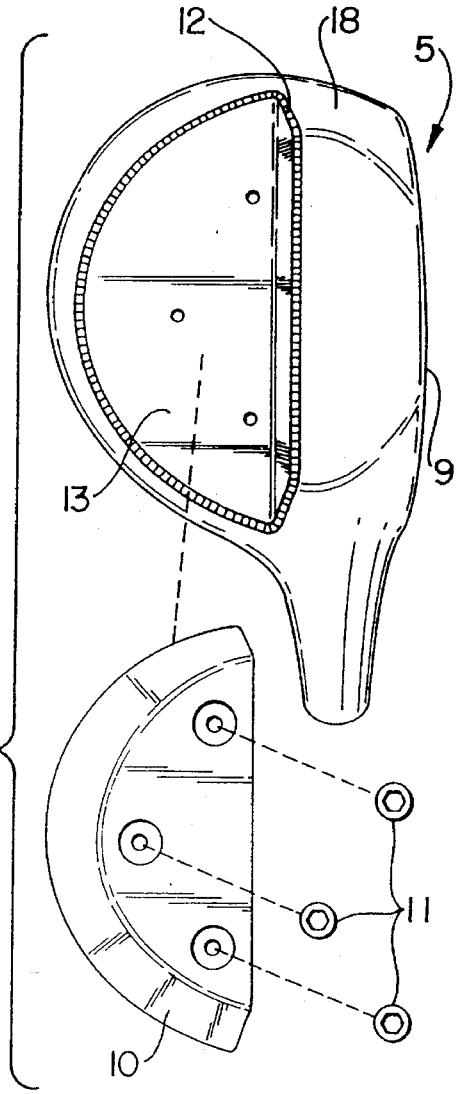
FIG. 5 shows an exploded bottom plan view of a golf club head embodiment of the present invention.

Referring to FIGS. 2 and 4, the club head 8 includes a ball striking face 9, a weight distributor 10, a cushion material 12, a hosel 17, a toe 18, a heel 19, a sole 20, and a back of the club head 21.

Referring to the drawings, the club head 8 has an external weighing system which includes a weight distributor 10 having apertures 14 and weights 15. The weights 15 are preferably spherical for prompt and easy insertion and removal. Rubber or other elastic plugs 16 can engage the weights 15 and securely hold them against the cushion 12 for positive positioning during swinging of the club head 5. The external weighing system is accessible to change the weights 15, for example, by removing three screws 11 and rearranging the weights 15 into the different apertures 14.

Figure 3:
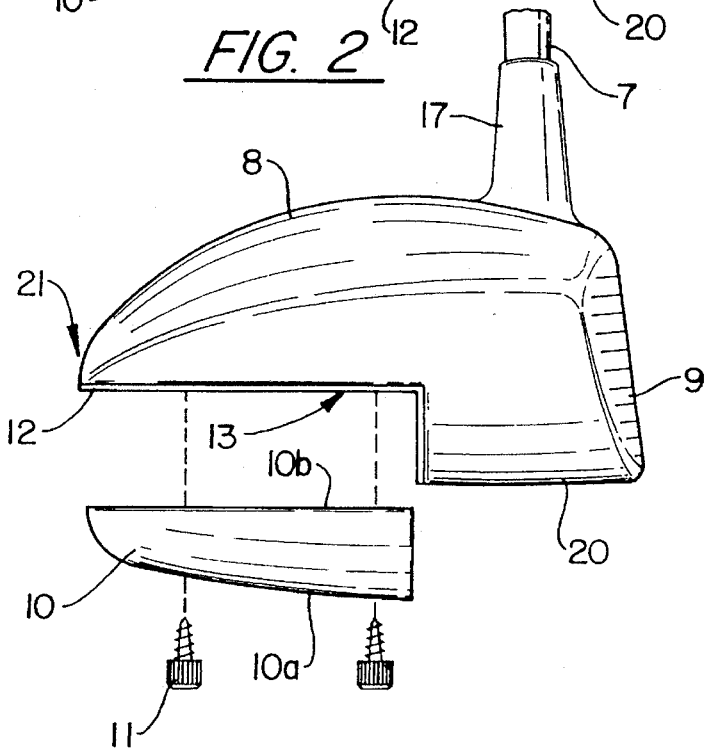
FIG. 3 shows an exploded side elevational view of a golf club head embodiment of the present invention.

Referring to FIG. 3, a cavity 13 can be formed in the back lower half of the club head 8 to provide for the placement of weight distributor 10. The cavity 13 is parallel to the sole 20 and of a D or horseshoe shape at the back of the club head 21. The cavity 13 is lined with a cushion material 12, which is preferably a soft thin rubber material or the like. Alternatively, the cavity 13 can also be lined with a plastic, cloth, silicon, or wood type material. It will be appreciated that the cavity 13 may be lined with a cushion material 12 to minimize vibration between the weight distributor 10, the club head 8, and the player's hands. This vibration can further be avoided by the resilient securement of the weights 15 by the plugs 16.

Figure 6:
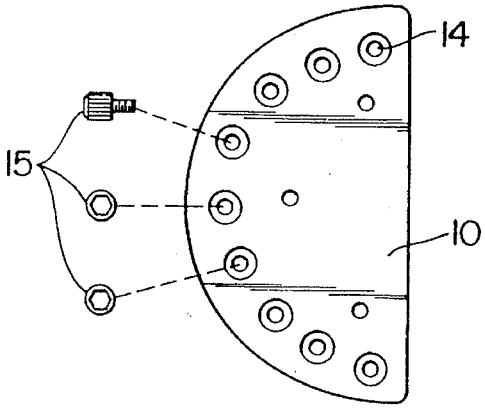
FIG. 6 shows an exploded top plan view of a weight distributor embodiment of the present invention.

The cavity 13 is preferably structured to matingly receive the weight distributor 10. The weight distributor 10 should be made of a lightweight metal or a lightweight composite material, such as fiberglass or plastic. The weight distributor 10 includes the plurality of cylindrical apertures 14 that when affixed to the club head 8 will be substantially perpendicular to the sole 20. As shown in FIG. 6, the apertures 14 are arranged in an array to allow for weight adjustments in the heel to toe direction well as fore and aft to precisely adjust the weight and swing characteristics of the club head.

Further the array apertures 14 are located on the pod 10 in a rear portion of the club head and preferably are arranged on the perimeter of the rear portion of the pod to maximize the distance from the striking face 9. Thus, weight adjustments affecting the striking face 9 can be achieved with minimized weights. The weight apertures 14 are preferably arranged behind the center of gravity of the club.

The weight distributor 10 should as exactly as possible fit to the size of the cavity 13 and, when attached to the club head 8, give the appearance of a one piece club head 8 as shown in FIG. 2.

The weight distributor 10 is preferably about ½ of an inch thick between the planar surfaces. The array of apertures 14 in the weight distributor 10 can extend substantially perpendicular to and between the planar surfaces and can be structured to receive a plurality of cylindrical weights 15 which may be positioned in a pre-selected number of the apertures 14 formed in the array.

The cup-like structure of the weight distributor 10 allows for the weights to remain in position when the weight distributor 10 is held upright. The weight distributor 10 is preferably constructed to have a bottom outer surface **10*a* and an upper outer surface 10*b***.

The bottom outer surface **10*a* preferably adjoins and extends from the sole 20** and forms part of the sole of the club.

Because the weight distributor is connected to the outside of the clubhead, the lower surface can be provided in a variety of shapes to change the aerodynamics and appearance of the clubhead. Manufacturers can dramatically change overall shape and weight distribution characteristics of a clubhead without compromising advantages in the remaining portion of the clubhead or incurring the expense of molds for new clubheads. The bottom outer surface **10*a* provides a stop point for the weights 15 when they are inserted into the apertures 14 of the weight distributor 10**.

Referring to FIGS. 3 and 6 together, there are preferably between six and twenty apertures 14 which allow the golfer to add weight to any part of the back of the club head 21 on the opposite side of the ball striking face 9 to fit the golfer's swing characteristics. By rearranging the weights 15, the sweet spot or center of gravity may be adjusted toward the toe 18 or the heel 19 and also from the back of the club head 21 towards the ball striking face 9.

Preferably, the weights 15 are spherical, cylindrical or screwlike in shape and may be made of a weighted material, such as brass, lead, tungsten or steel. Additionally, the weights can be constructed of different sizes and materials to provide adjustability of weighting. Depending on the overall weight of the club head 8, the number of weights 15 used to provide the optimum swing flex characteristics of the golf club 5 may be calculated. It will be appreciated that the length of the weights 15 corresponds to the height of the apertures 14 and the diameter of the weights 15 is sized to provide a comfortable fit into the apertures 14 for ease of insertion and withdrawal. It will be appreciated that a golfer may adjust the swing characteristics of the golf club 5 by repositioning the weights 15 in a preselected location within the array of apertures 14 of the weight distributor 10. To do this, screws 11 are removed and the weight distributor 10 is detached.

Alternatively, other fasteners such as a clip-on mechanism, hex bolts, or hand insertable screws can be used for quick and easy mounting and dismounting of the weight distributor 10. The one piece weight distributor 10, along with the screws 11, allow a golfer to make quick and easy adjustments of the weights 15. Furthermore, the one piece weight distributor 10 eliminates the need for a cover plate which can be cumbersome when changing the weights 15. A cover plate can also be easily lost or bent during mounting and dismounting of the weight distributor 10.

While various preferred embodiments have been shown and described, it will be understood that there is no intent to limit the invention by such disclosure, but rather, it is intended to cover all modifications and alternate constructions falling within the spirit and scope of the invention as defined in the appended claims.

I claim:

1. A wood type golf club having a shaft, a grip on one end of said shaft and a club head at the other end of said shaft; said club head including a heel, toe, upper surface, bottom sole, ball striking face and back of the club head wherein the improvement comprises:

a weighing system for adjustably moving the center of mass of the club head in a direction toward the toe, heel, ball striking face, or back of the club head in accordance with preselected parameters;

said weighing system providing a cavity oriented in a heel to toe direction located in the back lower half of the club head;

a weight distributor having a top outer surface and a bottom outer surface and sized to provide a snug fit in said cavity in a top to bottom and front to back direction, said bottom outer surface adjoining and extending from said bottom sole when said weight distributor is positioned in said cavity, said bottom outer surface forming a rear portion of the club head sole at a distance from the striking face;

said weight distributor including an array of apertures disposed between said top outer surface, and said bottom outer surface said array being arranged heel to toe and front to back, the front-most aperture of the apertures being spaced from said ball striking face and separate from the club head that forms said ball striking face, said front-most aperture being behind the center of gravity; and weights sized to provide a comfortable fit in said apertures, whereby said weights are inserted into said top outer surface and are located substantially behind said ball striking face and in said back of the club head.

2. The golf club of claim 1, wherein said weight distributor is made of a durable lightweight metal or composite material to accommodate the snug fit of said weight distributor in said cavity and to accommodate the snug fit of said weights in said apertures of said weight distributor.

3. The golf club of claim 1, wherein said bottom outer surface provides a stop point for said apertures.

4. The golf club of claim 3, further comprising a cushion in said cavity between cavity walls and said weight distributor, and further comprising at least one elastic plug inserted in one of said apertures for securely holding a weight against said cushion, whereby vibrations attributable to movement of the weight are minimized.

5. The golf club of claim 4, wherein said weights and said apertures are spherical in shape.

6. The golf club of claim 5, wherein said apertures have a longitudinal axis parallel to said bottom sole.

7. The golf club of claim 6, wherein said weight distributor extends between said heel and said toe at said back of the club head of the golf club.

8. The golf club of claim 7, wherein said cushion is made of a material selected from the group consisting of rubber, plastic, cloth, silicon and wood.

* * * * *